US011617449B2

(12) United States Patent
Li et al.

(10) Patent No.: US 11,617,449 B2
(45) Date of Patent: Apr. 4, 2023

(54) SOFA ARMREST

(71) Applicant: Remacro Technology Co., Ltd., Jiangsu (CN)

(72) Inventors: Xiaohong Li, Jiangsu (CN); Weiming Chen, Jiangsu (CN)

(73) Assignee: REMACRO TECHNOLOGY CO., LTD., Suzhou (CN)

( * ) Notice: Subject to any disclaimer, the term of this patent is extended or adjusted under 35 U.S.C. 154(b) by 25 days.

(21) Appl. No.: 17/255,996

(22) PCT Filed: Oct. 20, 2020

(86) PCT No.: PCT/CN2020/122032
§ 371 (c)(1),
(2) Date: Dec. 23, 2020

(87) PCT Pub. No.: WO2021/223374
PCT Pub. Date: Nov. 11, 2021

(65) Prior Publication Data

US 2022/0133050 A1 May 5, 2022

(30) Foreign Application Priority Data

May 6, 2020 (CN) ..... 202020726885.4

(51) Int. Cl.
*A47C 20/00* (2006.01)
*A47C 31/02* (2006.01)

(52) U.S. Cl.
CPC ..... *A47C 20/00* (2013.01); *A47C 31/023* (2013.01)

(58) Field of Classification Search
None
See application file for complete search history.

(56) References Cited

U.S. PATENT DOCUMENTS 6,843,531 B2 1/2005 Williams
2005/0017553 A1* 1/2005 Duncan ..... A47C 7/54 297/218.1

(Continued)

FOREIGN PATENT DOCUMENTS

CN 203563950 U 4/2014
CN 205682830 U 11/2016

(Continued)

OTHER PUBLICATIONS

Extended European Search Report of Counterpart European Patent Application No. 20828244.2 dated Sep. 13, 2021.

(Continued)

*Primary Examiner* — David E Allred

(57) ABSTRACT

The disclosure relates to a sofa armrest. The sofa armrest includes a main body made by blow molding, the upper end of the inner side surface of the main body is recessed inward to form a fabric mounting groove for mounting armrest fabric, and the lower end of the inner side surface of the main body is provided with clamping-connection grooves for being connected with connectors of a sofa underframe. The sofa armrest is made by a blow molding process, and compared with traditional solid sofa armrests, the sofa armrest has the advantages of low weight, high production speed and less manufacturing materials; when the armrest fabric is squeezed and deformed, debris accumulates on the lower wall of the fabric mounting groove or on a seat cover fabric, cleaning of dust and debris is facilitated, and the overall hygiene of a sofa is maintained.

6 Claims, 4 Drawing Sheets

(56) References Cited

U.S. PATENT DOCUMENTS

| | | | | |
|---|---|---|---|---|
| 2011/0043006 | A1* | 2/2011 | Butt | A47C 7/38 297/217.3 |
| 2014/0312661 | A1* | 10/2014 | Behar | A47C 15/002 297/452.1 |
| 2015/0130233 | A1 | 5/2015 | Thuma et al. | |
| 2018/0271286 | A1* | 9/2018 | Jacobs | A47C 7/727 |
| 2020/0029699 | A1 | 1/2020 | Brandtner et al. | |
| 2021/0112341 | A1* | 4/2021 | Nelson | A47C 7/72 |
| 2021/0289941 | A1* | 9/2021 | Brandtner | A47C 17/16 |
| 2022/0071398 | A1* | 3/2022 | Brandtner | A47C 5/12 |
| 2022/0400865 | A1* | 12/2022 | Lawson | A47C 17/02 |

FOREIGN PATENT DOCUMENTS

| | | | |
|---|---|---|---|
| CN | 108577322 | A | 9/2018 |
| CN | 110141066 | A | 8/2019 |
| JP | S56117851 | U | 9/1981 |
| TR | 201903428 | A2 | 4/2019 |
| WO | 2016044883 | A1 | 3/2016 |
| WO | 2020023979 | A1 | 1/2020 |

OTHER PUBLICATIONS

Examination Report of Counterpart Australian Patent Application No. 2020323952 dated Aug. 30, 2021.

* cited by examiner

SOFA ARMREST

FIELD OF THE INVENTION

The disclosure relates to the technical field of sofa accessories, in particular to a sofa armrest.

BACKGROUND OF THE INVENTION

Generally, sofas are provided with armrests so that persons sitting on the sofas can place their arms on the armrests. Therefore, the armrests of the sofas need to be able to provide sufficient supporting force to support the arms. In order to enable the armrests of the sofas to provide sufficient support, the armrests of the sofas are made of wooden structures, and are solid armrests, or are iron frames in the prior art, as a result, the armrests consume a lot of materials and are heavy and inconvenient to move; and the armrests take a long time to mount and manufacture, and the cost is high; the inner side surfaces of the armrests are flat surfaces, when armrest fabric is mounted on the armrests during leather change, the armrest fabric protrudes from the inner side surfaces of the armrests, the armrest fabric will be squeezed and deformed during the usage process of the sofas, causing debris to leak into spaces between a sofa underframe or the armrest fabric and seat cover fabric from gaps between the armrest fabric, debris is liable to accumulate and difficult to clean, which is not conducive to hygiene protection.

SUMMARY OF INVENTION

In order to overcome at least one of the above-mentioned defects in the prior art, the disclosure provides a sofa armrest.

The technical solutions adopted by the disclosure to solve the problems are as follows:

a sofa armrest includes a main body made by blow molding, wherein the upper end of the inner side surface of the main body is recessed inward to form a fabric mounting groove for mounting armrest fabric, and the lower end of the inner side surface of the main body is provided with clamping-connection grooves for being connected with connectors of a sofa underframe.

The sofa armrest provided by the disclosure is made by a blow molding process, and compared with traditional solid sofa armrests, the sofa armrest has the advantages of low weight, high production speed and less manufacturing materials; and through the fabric mounting groove and the clamping-connection grooves formed in the inner side surface of the main body, the fabric mounting groove is used for mounting the armrest fabric, then the armrest fabric is prevented from protruding from the inner side surface of the sofa armrest, and the clamping-connection grooves are used for mounting the connectors of the sofa underframe, so that the sofa armrest and the sofa underframe are conveniently connected without gaps. When the armrest fabric is squeezed and deformed, debris accumulates on the lower wall of the fabric mounting groove or on a seat cover fabric, cleaning of dust and debris is facilitated, and the overall hygiene of a sofa is maintained.

Further, the fabric mounting groove protrudes outward to form a mounting base for mounting a control device.

Therefore, the mounting base is used for mounting the control device, so that the control device does not need to be recessed into the armrest fabric, then mounting of the control device is facilitated, and a user can operate the control device conveniently.

Further, connecting through holes for fixing the connectors of the sofa underframe are formed in the clamping-connection grooves, and the connecting through holes penetrate through the main body.

Thus, when the sofa armrest is connected to the sofa underframe, bolts can penetrate through the connecting through holes from the outside of the main body inward so as to fix the connectors on the sofa underframe in the clamping-connection grooves, then the sofa armrest and the sofa underframe are fixedly connected, and the main body is not damaged, so that the overall strength of the main body is maintained, and the service life of the sofa armrest is prolonged.

Further, the sofa armrest further includes a cover body, the main body is provided with a storage cavity which is opened outwardly and is used for storing an electric wire, the cover body covers the storage cavity, and the mounting base is provided with a mounting hole communicating with the storage cavity, and the inner side surface of the main body 1 is further provided with a wire inlet which communicates with the storage cavity and is used for wire introduction.

Therefore, by adopting the mode of combining the main body with the cover body, the electric wire can be stored in the storage cavity of the main body, the internal space of the main body is effectively used, storage of the electric wire and maintenance are facilitated, and the electrical safety level raises.

Further, two clamping-connection grooves are arranged correspondingly, the wire inlet is located in the clamping-connection groove at the side close to a sofa backrest, and a wiring groove communicating with the wire inlet is further formed in the main body.

Therefore, during wiring, the electric wire can be arranged along the wiring groove, so that the electric wire does not protrude from the side surface of the main body and the surface of the corresponding clamping-connection groove, and the sofa armrest can be more closely attached to the sofa underframe; and when the connectors on the sofa underframe are mounted in the clamping-connection grooves, the connectors can cover the wire inlet and the wiring groove to prevent dust or small insects from entering the storage cavity of the main body from the wire inlet.

Further, the main body is provided with at least one concave hole for enhancing the bearing capacity of the main body, and the cover body covers the storage cavity and the concave holes.

Thus, the concave holes are used for enhancing the bearing capacity of the main body, and the cover body covers the storage cavity and the concave holes, so that the flatness of the surface of the sofa armrest is maintained, and the usage experience of the sofa armrest is improved.

Further, at least one protrusion for enhancing the bearing capacity of the main body is arranged in the storage cavity, and the protrusions are vertically arranged.

As a result, by forming the vertically arranged protrusions to enhance the bearing capacity of the main body, and the problem that the bearing capacity of the main body is lowered due to the arrangement of the storage cavity is avoided.

Further, the protrusions are provided with fixing grooves for clamping and fixing an electric wire.

Therefore, by clamping and fixing the electric wire through the fixing grooves, the electric wire is prevented from shaking in the storage cavity and causing abnormal noise, and thus wiring management is facilitated.

Further, a baffle plate is arranged under the main body, and the baffle plate is made of the main body by integral blow molding.

Therefore, when the bottom of the sofa armrest is suspended and mounted on the sofa, the baffle plate can block the sofa support underframe at the bottom to prevent foreign matters from entering, and a beautifying effect is achieved; and the baffle plate made of the main body by integral blow molding is higher in strength, and does not need to be mounted again, so that assembly steps are reduced.

Further, supporting feet are further detachably arranged under the main body, the supporting feet are provided with positioning blocks, and the main body is provided with positioning grooves matched with the positioning blocks.

Therefore, the sofa armrest can be applied to a sofa with iron frames on the ground and a sofa with armrests on the ground, and through cooperation of the positioning blocks and the positioning grooves, positioning and mounting of the supporting feet are facilitated, and the supporting feet are not prone to shaking.

Compared with the prior art, the disclosure has the following advantages:

the sofa armrest of the disclosure is made by a blow molding process, and compared with traditional solid sofa armrests, the sofa armrest has the advantages of low weight, high production speed and less manufacturing materials; through the fabric mounting groove and the clamping-connection grooves formed in the inner side surface of the main body, the fabric mounting groove is used for mounting the armrest fabric, then the armrest fabric is prevented from protruding from the inner side surface of the sofa armrest, and the clamping-connection grooves are used for mounting the connectors of the sofa underframe, so that the sofa armrest and the sofa underframe are conveniently connected without gaps, when the armrest fabric is squeezed and deformed, debris accumulates on the lower wall of the fabric mounting groove or on a seat cover fabric, cleaning of dust and debris is facilitated, and the overall hygiene of a sofa is maintained; and the mounting base is used for mounting the control device, so that the control device does not need to be recessed into the armrest fabric, mounting of the control device is facilitated, and a user can operate the control device conveniently.

Figure 1:
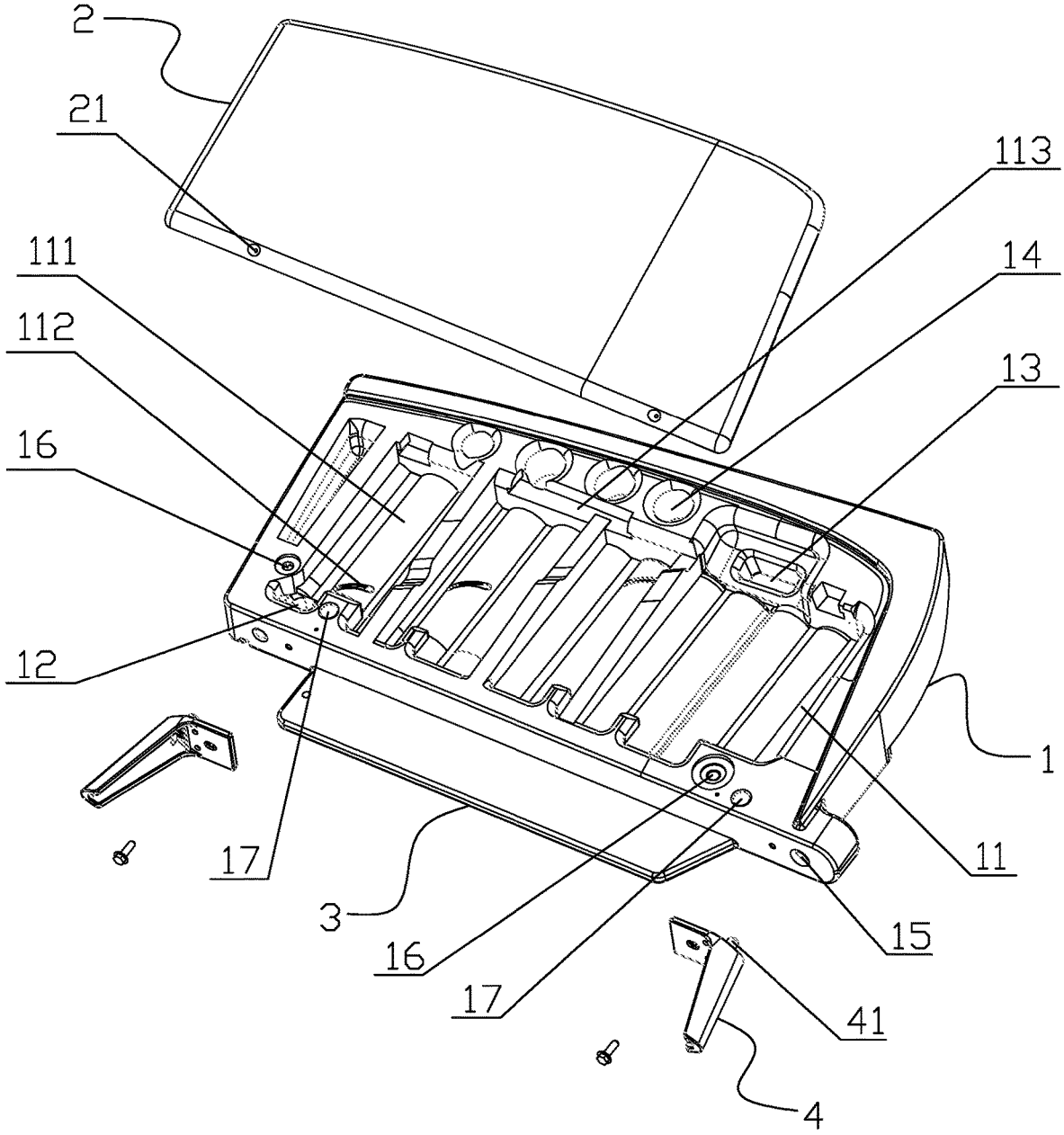
FIG. 1 is an exploded schematic diagram of a sofa armrest provided by the disclosure.

Wherein, the reference numerals represent:

1, main body; 11, storage cavity; 111, protrusions; 112, fixing grooves; 113, clamping groove; 12, wire inlet; 121, wiring groove; 13, mounting hole; 14, concave holes; 15, positioning grooves; 16, connecting through holes; 161, clamping-connection grooves; 17, positioning ball grooves; 18, fabric mounting groove; 19, mounting base; 2, cover body; 21, counterbore holes; 22, clamping block; 23, hemispherical heads; 3, baffle plate; 4, supporting feet; and 41, positioning blocks.

DETAILED DESCRIPTION OF THE ILLUSTRATED EMBODIMENTS

The technical solutions in the embodiments of the disclosure will be clearly and completely described in conjunction with the accompanying drawings in the embodiments of the disclosure below. Apparently, the described embodiments are only a part of the embodiments of the disclosure, rather than all the embodiments. Based on the embodiments of the disclosure, all other embodiments obtained by those of ordinary skill in the art without creative work shall fall within the protection scope of the disclosure.

It should be noted that all directional indicators (such as upper, lower, left, right, front, back, outside, inside . . . ) in the embodiments of the disclosure are only used to explain the relative positional relationship and movement of the components in a specific posture (as shown in the figures). If the specific posture changes, the directional indicator changes accordingly.

Referring to FIGS. 1 to 4, the disclosure discloses a sofa armrest which includes a main body 1 and a cover body 2, the main body 1 is made by blow molding, the main body 1 is provided with a storage cavity 11 which is opened outwardly and is used for storing an electric wire, the main body 1 is provided with a wire inlet 12 for wire introduction and a mounting hole 13 for mounting a control device, and the wire inlet 12 and the mounting hole 13 communicate with the storage cavity 11; the cover body 2 is detachably connected to the main body 1 so as to cover the storage cavity 11. Wherein, the wire inlet 12 is located at the lower end of the main body 1 and is close to the rear end of a sofa, and the mounting hole 13 is located at the upper end of the main body 1 and is close to the front end of the sofa.

Since the main body 1 of the sofa armrest is made by a blow molding process, the main body 1 is internally provided with a cavity, and compared with traditional solid sofa armrests, the sofa armrest has the advantages of low weight, high production speed and less manufacturing materials; on the other hand, since the main body 1 and the cover body 2 are combined to cover the storage cavity 11 in the main body 1, the electric wire can be stored in the storage cavity 11, and the internal space of the main body 1 is effectively used, storage of the electric wire and maintenance are facilitated, and the electrical safety level raises.

In this embodiment, the cover body 2 is also made by blow molding. Indeed, the cover body 2 can also be made by injection molding in other preferred embodiments, and the disclosure does not specifically limit the manufacturing method and material of the cover body 2.

Figure 2:
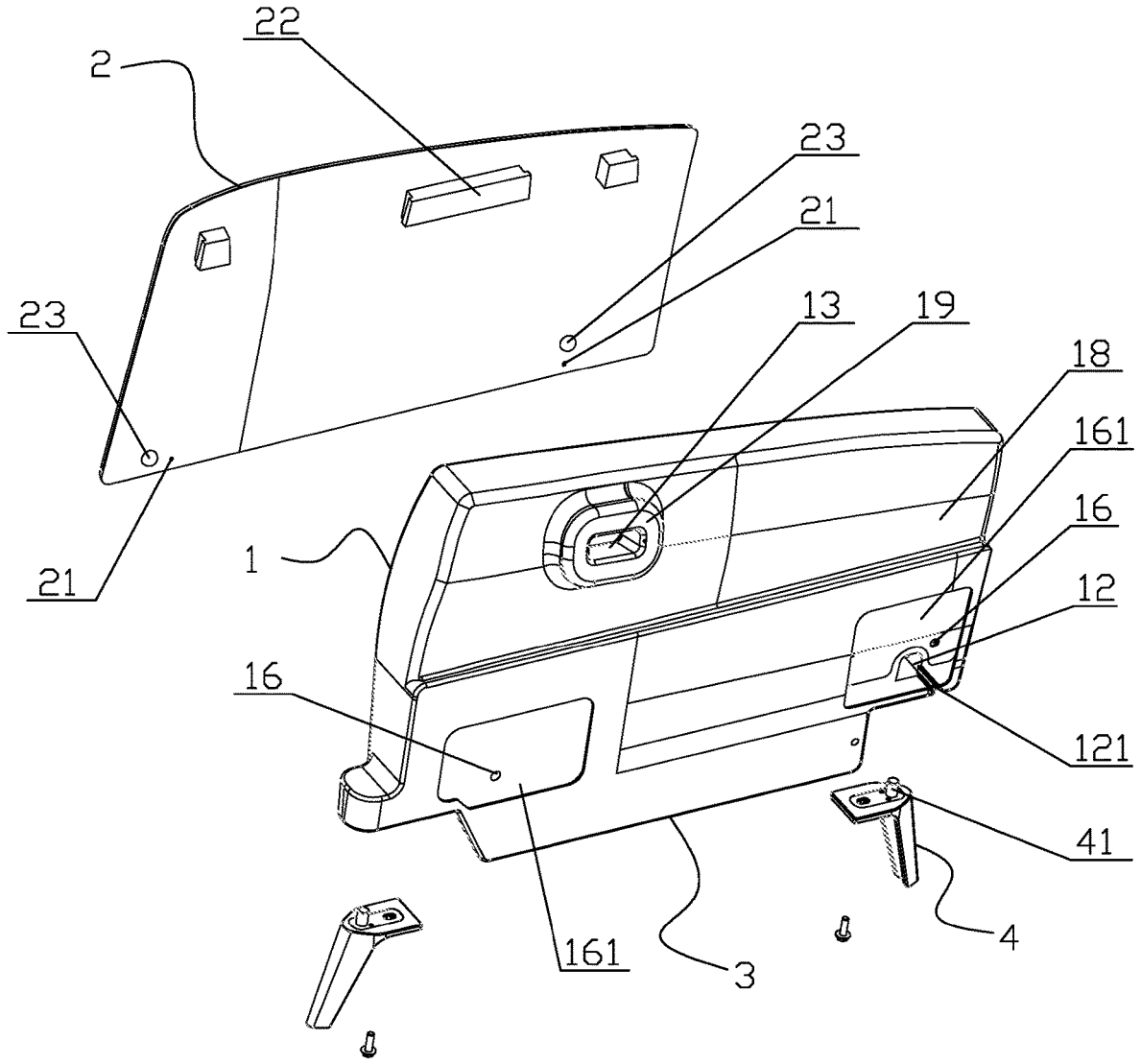
FIG. 2 is an exploded schematic diagram of a sofa armrest provided by the disclosure from another angle.

Referring to FIGS. 1 and 2, in order to detachably connect the cover body 2 with the main body 1, a clamping groove 113 is formed in the upper end of the outer side surface of the main body 1, the upper end of the inner side surface of the cover body 2 is provided with a clamping block 22 which is in insertion-clamping fit with the clamping groove 113, and the lower end of the cover body 2 is further provided with counterbore holes 21. During mounting, the cover body 2 is moved from bottom to top, and the clamping block 22 is inserted upwards into the clamping groove 113, thus the cover body 2 is initially positioned on the main body 1, and then screws penetrate through the counterbore holes 21 and are screwed to the main body 1, so that the cover body 2 and the main body 1 are relatively fixed.

In this embodiment, due to the blow molding accuracy of the cover body 2 and the main body 1, when the clamping groove 113 and the clamping block 22 are in insertion-clamping fit, there is a large gap between the cover body 2 and the main body 1, then the lower end of the cover body 2 is liable to swing, as a result, the counterbore holes 21 are difficult to correspond to corresponding screw holes in the main body 1, and final screw fixation is difficult. Based on this, the lower end of the outer side surface of the main body 1 is further provided with two positioning ball grooves 17, the lower end of the inner side surface of the cover body 2 is provided with hemispherical heads 23 matched with the positioning ball grooves 17, and the positioning ball grooves 17 are matched with the hemispherical heads 23 to strengthen relative positioning of the cover body 2 and the main body 1, so that subsequent screw fixation is facilitated.

Figure 3:
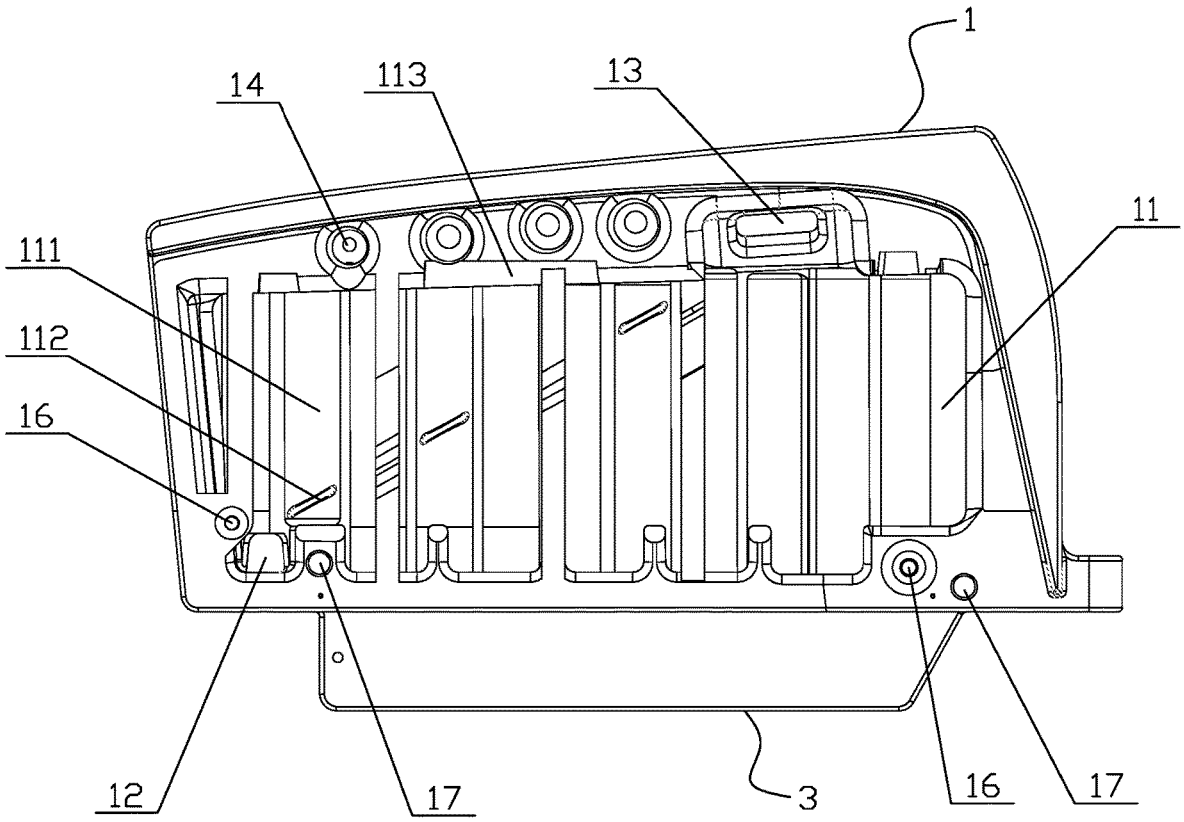
FIG. 3 is a schematic structural diagram of a main body and a baffle plate shown in FIG. 1.

Referring to FIGS. 1 and 3, in this embodiment, the main body 1 is provided with at least one concave hole 14 for enhancing the bearing capacity of the main body 1, and the cover body 2 covers the storage cavity 11 and the concave holes 14. Specifically, four concave holes 14 are arranged side by side, and the four concave holes 14 are all located above the storage cavity 11, so that sufficient supporting force is provided for the sofa armrest surface of the upper end of the main body 1.

Preferably, the concave holes 14 are of a conical shape, and the cross section of each concave hole is gradually reduced from the outside of the main body 1 to the inside. As a result, the concave holes 14 can form spiral bodies in the cavity of the main body 1, the hardness of the main body 1 is further enhanced through the spiral bodies, and when the main body 1 is squeezed by an external object, the bottoms of the spiral bodies can prevent the main body 1 from being further deformed. For example, when the outer side surface of the main body 1 is squeezed by an object, the outer side surface deforms toward the inner side surface of the main body 1, during the deformation, the outer side surface contacts the bottoms of the spiral bodies, then the deformation is obstructed, and therefore the main body 1 is prevented from further deforming.

On the other hand, since the cover body 2 covers the storage cavity 11 and the concave holes 14, the flatness of the surface of the sofa armrest is maintained, and the usage experience of the sofa armrest is improved.

Referring to FIGS. 1 and 3, in this embodiment, at least one protrusion 111 for enhancing the bearing capacity of the main body 1 is arranged in the storage cavity 11, and the protrusions 111 are vertically arranged. Specifically, the protrusions 111 are of an arch shape, the lower ends of the protrusions 111 are connected with the lower wall of the storage cavity 11, and the upper ends of the protrusions 111 are connected with the upper wall of the storage cavity 11, therefore the bearing capacity of the main body 1 is further enhanced through the vertically arranged protrusions 111, and the problem that the bearing capacity of the main body 1 is lowered due to the arrangement of the storage cavity 11 is avoided; on the other hand, the arch-shaped protrusions 111 can reduce the amount of raw materials while providing sufficient bearing capacity, and can also increase the lateral bearing strength of the main body 1.

Referring to FIGS. 1 and 3, in this embodiment, the protrusions 111 are provided with fixing grooves 112 for clamping and fixing an electric wire. When the electric wire is arranged in the storage cavity 11, the electric wire can be clamped and fixed through the fixing grooves 112 and is prevented from shaking in the storage cavity 11 and causing abnormal noise, and thus wiring management is facilitated.

Referring to FIG. 1, in this embodiment, the sofa armrest of the disclosure is mounted on a sofa, and the sofa has two support modes: iron frames on the ground and armrests on the ground. When the sofa armrest is applied to the sofa with iron frames on the ground, the bottom of the sofa armrest is suspended, and then a sofa support underframe at the bottom of the sofa is exposed. Based on this, a baffle plate 3 is arranged under the main body 1 of the disclosure. Therefore, when the bottom of the sofa armrest is suspended and mounted on the sofa, the baffle plate 3 can block the sofa support underframe at the bottom of the sofa to prevent foreign matters from entering, and a beautifying effect is achieved.

Wherein, preferably, the baffle plate 3 is made of the main body 1 by integral blow molding. As a result, the baffle plate 3 made of the main body 1 by integral blow molding is higher in strength, and does not need to be mounted again, so that assembly steps are reduced.

Referring to FIGS. 1 and 2, in this embodiment, when the sofa armrest is applied to the sofa with armrests on the ground, the bottom of the armrest of the sofa needs to be supported on the ground. Based on this, the bottom of the main body 1 of the disclosure is detachably provided with supporting feet 4. Wherein, two supporting feet 4 are arranged, and the two supporting feet 4 are correspondingly connected to the two sides of the lower end of the main body 1, the supporting feet 4 are provided with positioning blocks 41, and the main body 1 is provided with positioning grooves 15 matched with the positioning blocks 41. Therefore, through cooperation between the positioning blocks 41 and the positioning grooves 15, positioning and mounting of the supporting feet 4 are facilitated, and the supporting feet 4 are not prone to shaking.

Specifically, the supporting feet 4 are further provided with through holes. During mounting, the positioning blocks 41 are inserted into the positioning grooves 15 to position the supporting feet 4 on the main body 1, and then screws are used to penetrate through the through holes in the supporting feet 4 so as to fix the supporting feet 4 on the main body 1, so that the supporting feet 4 are mounted.

Through the above-mentioned baffle plate 3 and the supporting feet 4, the sofa armrest can be applied to the sofa with iron frames on the ground and the sofa with armrests on the ground.

Figure 4:
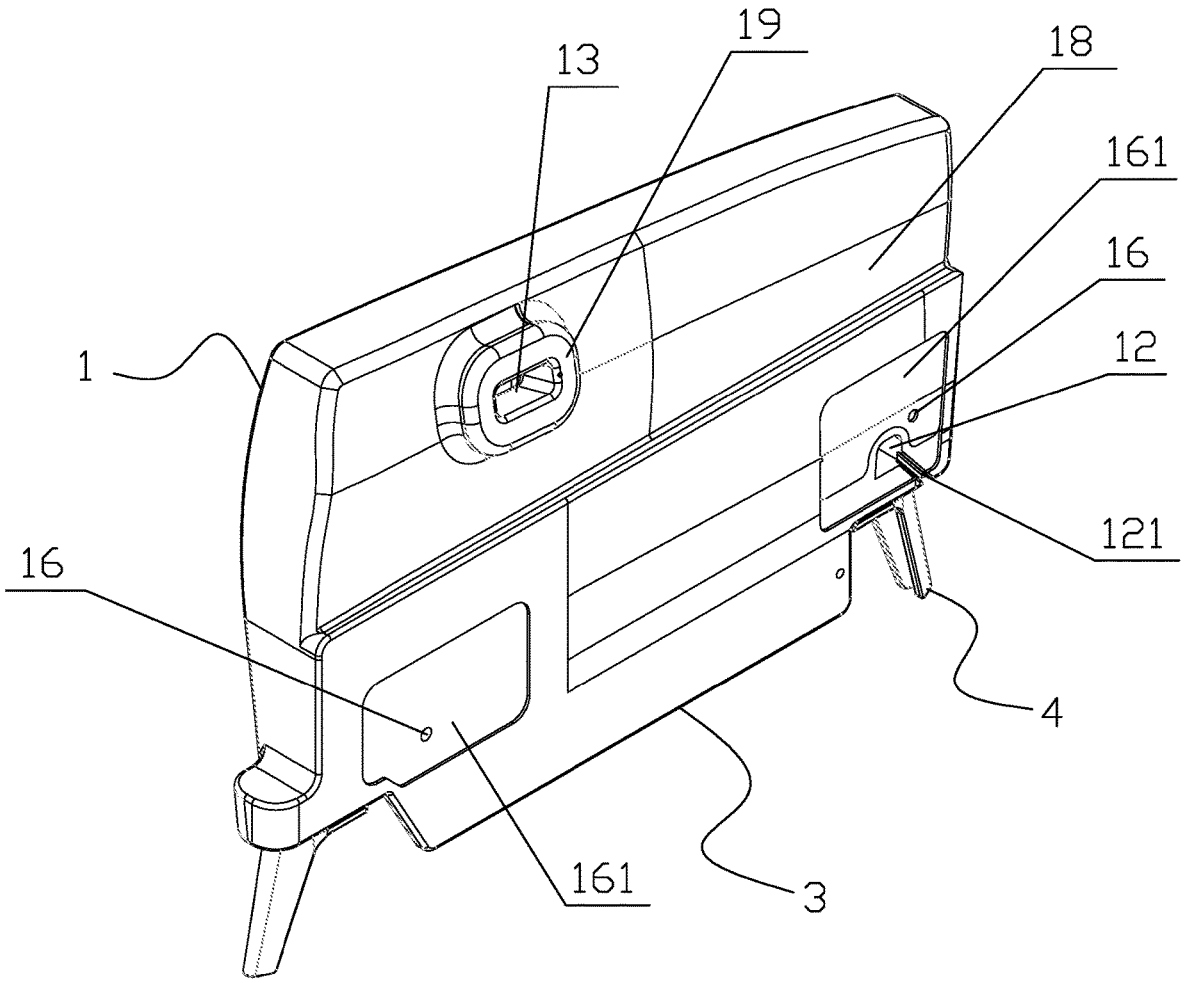
FIG. 4 is a schematic structural diagram of a sofa armrest provided by the disclosure.

Referring to FIGS. 2 and 4, in this embodiment, the inner side surface of the main body 1 is roughly stepped, wherein the upper end of the inner side surface of the main body 1 is recessed inward to form a fabric mounting groove 18 for mounting armrest fabric, the fabric mounting groove 18 protrudes outward to form a mounting base 19 for mounting a control device, and the mounting hole 13 is correspondingly arranged in the mounting base 19. When in use, the control device is mounted on the mounting base 19 and partially penetrates into the mounting hole 13, and the electric wire for being electrically connected with the control device extends into the storage cavity 11 from the mounting hole 13.

In the prior art, the inner side surface of the sofa armrest is a flat surface. When the armrest fabric is mounted on the sofa armrest during leather change, the armrest fabric protrudes from the inner side surface of the armrest, the armrest fabric will be squeezed and deformed during the usage process of the sofa, causing debris to leak into spaces between a sofa underframe or the armrest fabric and seat cover fabric from gaps between the armrest fabric, debris is liable to accumulate and difficult to clean, which is not conducive to hygiene protection. In the disclosure, by forming the fabric mounting groove 18 in the inner side surface of the main body 1, the armrest fabric is mounted in the fabric mounting groove 18. Preferably, the depth of the fabric mounting groove 18 is the same as the thickness of the armrest fabric correspondingly, when the armrest fabric is squeezed and deformed, debris accumulates on the lower wall of the fabric mounting groove 18 (namely the stepped surface of the inner side surface of the main body 1) or the seat cover fabric, dust and debris cleaning is facilitated to maintain the overall hygiene of the sofa; on the other hand, since the mounting base 19 protrudes from the fabric mounting groove 18, the armrest fabric may be provided with an avoidance position to avoid the mounting base 19, and the control device can be mounted on the mounting base 19, the control device does not need to be recessed into the armrest fabric for mounting, then mounting of the control device is facilitated, and a user can operate the control device conveniently.

Referring to FIGS. 2 and 4, in this embodiment, the lower end of the inner side surface of the main body 1 is provided with two clamping-connection grooves 161 for being connected with connectors of a sofa underframe, and the two clamping-connection grooves 161 are arranged correspondingly, wherein, one of the clamping-connection grooves 161 is located at the side, close to a sofa backrest, of the sofa armrest, and the other clamping-connection groove 161 is located at the side close to the front end of the sofa. Preferably, the depth of the clamping-connection grooves 161 is matched with the thickness of the connectors, and the clamping-connection grooves 161 are matched with the connectors in shape, so that the connectors are perfectly fitted in the clamping-connection grooves 161, and connection between the sofa armrest and the sofa underframe without any gap is facilitated.

In this embodiment, each clamping-connection groove 161 is internally provided with a connecting through hole 16, that is, the connecting through holes 16 penetrate through the main body 1 through the clamping-connection grooves 161. When the sofa armrest is connected to the sofa underframe, bolts can penetrate through the connecting through holes 16 from the outside of the main body 1 inward, so that the connectors on the sofa underframe are fixed in the clamping-connection grooves 161, and the sofa armrest is fixedly connected with the sofa underframe. Compared with the rivet fixing method in the prior art, by forming the connecting through holes 16 in the main body 1 of the disclosure, and bolts are used to penetrate through the connecting through holes 16 and fixedly connected to the connectors on the sofa underframe, and the main body 1 is not damaged, so that the overall strength of the main body 1 is maintained, and the service life of the sofa armrest is prolonged.

Preferably, when the cover body 2 is mounted on the main body 1, the cover body 2 covers the connecting through holes 16 to avoid the connecting through holes 16 and the bolts mounted in the connecting through holes 16 are exposed, so that the flatness of the surface of the sofa armrest is maintained, and rusty bolts or grease on bolts can be prevented from polluting the armrest fabric during use.

In this embodiment, the wire inlet 12 is located in the clamping-connection groove 161 at the side close to a sofa backrest, and a wiring groove 121 communicating with the wire inlet 12 is further formed in the inner side surface of the main body 1. Specifically, the wiring groove 121 is formed by recessing the corresponding clamping-connection groove 161 inward, and extends from the wire inlet 12 to the lower portion of the main body 1. Therefore, during wiring, the electric wire can be arranged along the wiring groove 121, so that the electric wire does not protrude from the side surface of the main body 1 and the surface of the corresponding clamping-connection groove 161, and the sofa armrest can be more closely attached to the sofa underframe; and when the connectors on the sofa underframe are mounted in the clamping-connection grooves 161, the connectors can cover the wire inlet 12 and the wiring groove 121 to prevent dust or small insects from entering the storage cavity 11 of the main body 1 from the wire inlet 12.

The technical means disclosed in the solutions of the disclosure are not limited to the technical means disclosed in the above-mentioned embodiments, but also include technical solutions composed of any combination of the above technical features. It should be noted that those of ordinary skill in the art can make several improvements and modifications without departing from the principle of the disclosure, and these improvements and modifications are also deemed to be within the protection scope of the disclosure.

What is claimed is:

1. A sofa armrest, characterized by comprising a main body made by blow molding, wherein an upper end of an inner side surface of the main body is recessed relative to a lower end of the inner side surface to form a fabric mounting groove for mounting armrest fabric, and the lower end of the inner side surface of the main body is provided with clamping-connection grooves for being connected with connectors of a sofa underframe, wherein connecting through holes for fixing the connectors of the sofa underframe are formed in the clamping-connection grooves, and the connecting through holes penetrate through the main body;

a mounting base protruding relative to the fabric mounting groove and the upper end of the inner side surface, the mounting base for mounting a control device;

a cover body, wherein the main body is provided with a storage cavity which is opened from an outer side surface of the main body and is used for storing an electric wire, the cover body covers the storage cavity, and the mounting base is provided with a mounting hole communicating with the storage cavity, and the lower end of the inner side surface is further provided with a wire inlet which communicates with the storage cavity and is used for wire introduction;

wherein two of the clamping-connection grooves are formed correspondingly, the wire inlet is located in the clamping-connection groove at a side close to a sofa backrest, and a wiring groove communicating with the wire inlet is further formed in the main body.

2. The sofa armrest according to claim 1, characterized in that: the main body is provided with at least one concave hole for enhancing a bearing capacity of the main body, and the cover body covers the storage cavity and the at least one concave hole.

3. The sofa armrest according to claim 1, characterized in that: at least one protrusion for enhancing a bearing capacity of the main body is arranged in the storage cavity, and the at least one protrusion is vertically arranged.

4. The sofa armrest according to claim 3, comprising: a plurality of protrusions, including the at least one protrusion, characterized in that: the protrusions are provided with fixing grooves for clamping and fixing an electric wire.

5. The sofa armrest according to claim 1, characterized in that: a baffle plate is arranged under the main body, and the baffle plate is made of the main body by integral blow molding.

6. The sofa armrest according to claim 1, characterized in that: supporting feet are further detachably arranged under the main body, the supporting feet are provided with positioning blocks, and the main body is provided with positioning grooves matched with the positioning blocks.

* * * * *